US005112287A

United States Patent [19]

Brewer

[11] Patent Number: 5,112,287

[45] Date of Patent: May 12, 1992

[54] EXERCISING DEVICE

[76] Inventor: Aaron F. Brewer, 7620 Valentine St., Oakland, Calif. 94605

[21] Appl. No.: 619,073

[22] Filed: Nov. 27, 1990

[51] Int. Cl.[5] ..... A63B 21/00

[52] U.S. Cl. ..... 482/130; 482/133; 482/123

[58] Field of Search ..... 272/137, 142, 136, 138, 272/139, 135, 143, 126, 134

[56] References Cited

U.S. PATENT DOCUMENTS

| | | | |
|---|---|---|---|
| 1,019,861 | 3/1912 | Titus | 272/138 |
| 1,734,238 | 11/1929 | Sweeney . | |
| 1,866,868 | 10/1928 | Thomson et al. | 272/142 X |
| 2,467,943 | 4/1944 | Mikell, Jr. . | |
| 3,215,429 | 11/1965 | Shaboo et al. . | |
| 4,371,162 | 2/1983 | Hartzell | 272/134 |
| 4,544,155 | 10/1985 | Wallenbrock et al. | 272/136 |

FOREIGN PATENT DOCUMENTS

| | | | |
|---|---|---|---|
| 535559 | 10/1931 | Fed. Rep. of Germany | 272/136 |
| 2048085 | 12/1980 | United Kingdom | 272/138 |

OTHER PUBLICATIONS

*Built & Company*, blueprint dated Apr. 25, 1988; photograph and sales brochure.

*Primary Examiner*—Richard J. Apley
*Assistant Examiner*—D. F. Crosby
*Attorney, Agent, or Firm*—Kathleen A. Skinner

[57] ABSTRACT

An exercising device has a stool-like base portion with vertical support members and spacing members to keep the vertical support members apart. The vertical support members have horizontal bottom portions and angled side portions on which are mounted a plurality of receiving members. Tension members are releasably attached by their one end to selected receiving members and attached at their other end to any one of various body engaging members. The resistance experienced by a person exerting force to pull or push the body engaging member away from the exercising device can be varied by selecting different receiving members.

16 Claims, 3 Drawing Sheets

EXERCISING DEVICE

BACKGROUND OF THE INVENTION

1. Field of the Invention

The present invention relates to the field of exercise and fitness aids, and, more particularly, to a portable exercising device for developing and maintaining muscle tone especially in the upper body.

2. Description of the Related Art

There are numerous kinds of exercise and fitness equipment currently used by persons for rehabilitating certain muscle groups following surgery or injury or for achieving and maintaining a desired fitness level. Very elaborate and specialized apparatus and devices are used effectively in gyms and fitness centers for controlled anaerobic exercises, which are movements based on resistance to tension or weights, but, due to cost and space requirements for storage and use, such specialized devices are generally unavailable for home or private use.

On the other hand, many persons who are recovering from an illness or injury or who prefer to exercise privately or on their own schedules without traveling to a gym, would like to perform standard anaerobic exercises in their home or office. Many simple exercising devices are available for home use which substitute exercises for the routines which are commonly performed only with gym equipment. However, many people prefer the professional gym routines and would like to use an exercising device to perform a variety of controlled exercises which they have been accustomed to doing with more elaborate equipment in their own location.

Thus, there is a need for an exercising device which makes many common anaerobic exercises easy to perform in a private setting, a device which is small enough and lightweight enough to be easily moved to a desired location for use and then out of the way when not in use, and a device which can make a variety of typical resistance exercises possible with a single apparatus and without requiring numerous benches and large specialized machines. The present invention provides such a device which solves these needs.

SUMMARY OF THE INVENTION

The present invention is an exercising device with a stool-like base and vertical support members which are generally triangular in shape. The vertical support members each have a horizontal bottom portion and an angled side portion and spacing members to keep the vertical support members securely spaced apart. Receiving members, which are preferably a plurality of spaced rigid hooks, are secured to the angled side portion of the support member in a spaced arrangement for securing one or two tension members at a selected position or positions along the angled side portion.

A single tension member can be detachably secured by connecting means disposed at one of its ends to a selected receiving member on the angled side portion of the vertical support member. At its other end the tension member can be similarly secured to a stirrup-like loop. The stirrup can then be gripped by the hand and pulled away from the base under tension at a variety of angles and positions to work specific muscle groups in the arm and upper body. The amount of tension experienced by the user will depend upon the location of the receiving member selected and the position of the user and can be easily changed. The second tension member can be similarly attached to a stirrup on one end and, on the other end, to a receiving member located on the other vertical support member. With this double stirrup arrangement, both arms can move against tension in a variety of symmetrical, complementary, cross-over and other motions.

Alternatively, both tension members can be secured at their first ends to receiving members located at corresponding positions on both angled side portions. At their second ends, the tension members can be secured to receiving members proximate each end of a tubular bar. A person can grasp the bar with two hands and can perform curling actions with it and other pulling and pressing movements for upper body conditioning. The tension members can be easily detached and reattached to corresponding receiving members located at a distance farther or closer to the body to vary the tension applied to the muscle groups.

The base may also include a seat mounted proximate its top and a foot platform anchored to the vertical support members on the rear side of the base portion (that is, the side opposite the angled portions which have the receiving members). A strap is secured to the foot platform so that a person can slip both feet under the strap, sit on the seat facing the rear side and use the tubular bar to perform military presses, as well. Thus this invention has an expanded range of upper body fitness exercises which can be performed with one device.

In addition, a receiving member may be mounted on the inside of the foot platform to anchor one of the ends of a tension member. An ankle strap attached to the other end of the tension member can be mounted on the ankle and a person can move his or her leg away from the base against tension to work various muscle groups in the legs, as well. Moreover, the features of this invention can be uniquely combined with a prior version of the exercising device, which is directed primarily to lower body conditioning, to provide an exercising device for overall fitness.

Thus, it is an object of this invention to provide an exercising device which is versatile and provides the means for performing a variety of familiar controlled exercises. Another objective of this invention is to provide a lightweight yet durable device which can be easily moved and stored and which can be conveniently used to perform a range of exercises within a moderate amount of space in one's home or office. It is another object of this invention to provide an exercising device, particularly for the upper body muscles, which allows one to quickly and easily vary the tension to be experienced by the muscle groups, to adjust for individual differences and intensity needs.

DESCRIPTION OF THE PREFERRED EMBODIMENTS

Figure 1:
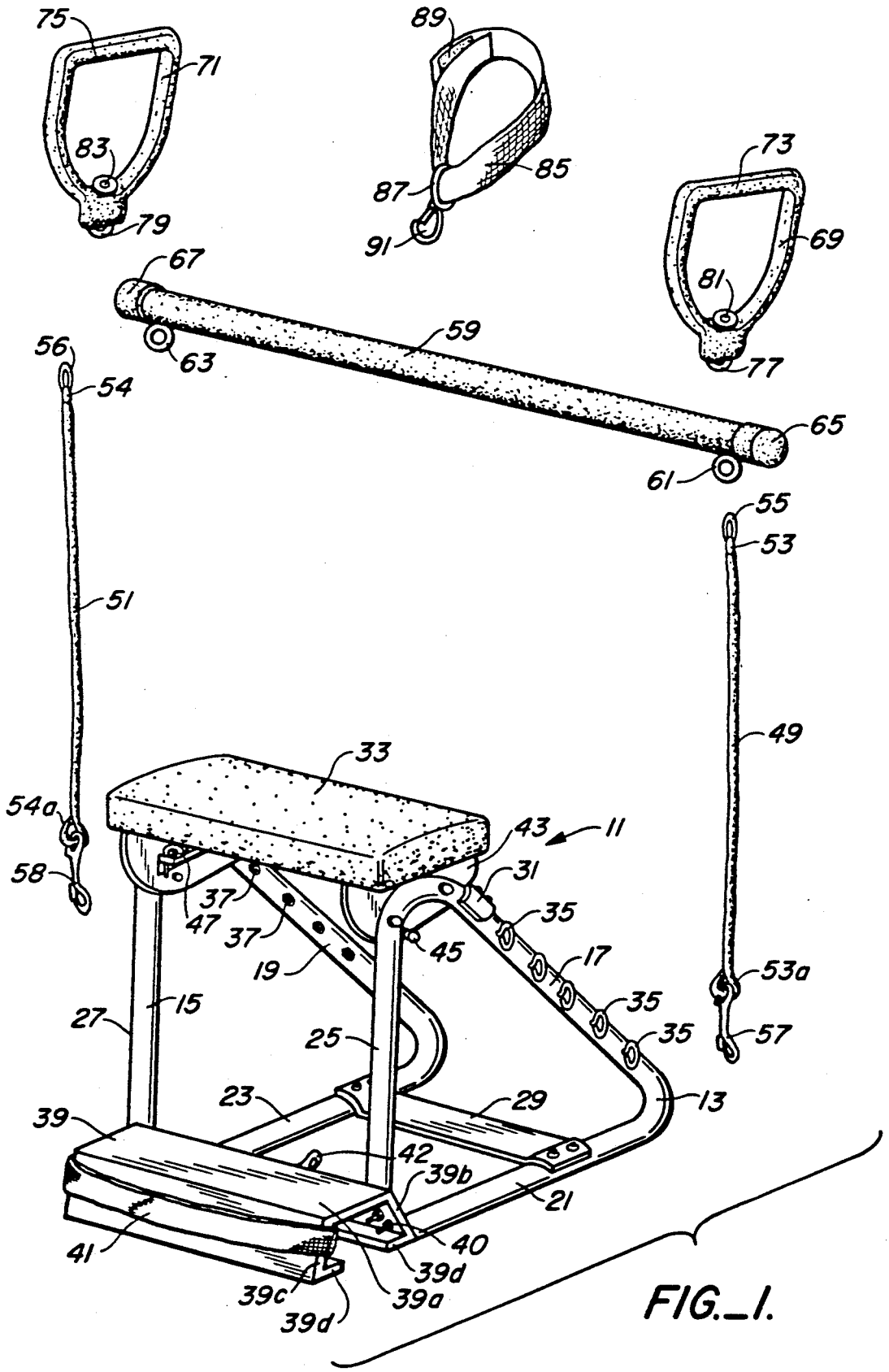
FIG. 1 is a rear perspective view of the exercising device of this invention, showing the removable and alternative portions of the invention.

The present invention is an exercising device which has a stool-like base portion 11, having a pair of vertical support members 13, 15. Each of these vertical support members has at least one angled side portion 17 or 19, respectively, and a horizontal bottom portion 21 or 23, respectively. While the base portion of the invention could comprise a unitary piece of heavy metal, angled as described hereafter, the preferred construction includes second side portions 25, 27 for additional stability. These second side portions may also be angled, or they may be generally perpendicular, to the horizontal bottom portions. While the vertical support members could consist of solid walls, the use of vertical support members formed into an open configuration provides a lighter weight structure. Each vertical support member is preferably formed from continuous lightweight tubular material in which the angled side portion and second side portion are connected to opposite ends of the horizontal bottom portion and join with each other to form an apex at the top. The tubular material is thus preferably formed into a generally triangular shape. Alternatively, the side portions could connect at the top to a horizontal portion to form a four-sided open support member.

Spacing means secures the vertical support members 13, 15 in a spaced relation with each other. The spacing means includes at least a lower spacing member 29 and an upper spacing member 31. The spacing members are preferably flat rigid bars or straps of durable material which are mounted to the vertical support members to anchor them in a spaced position, usually with sufficient space to allow a person to conveniently stand between the vertical support members. In the embodiment shown in the drawings, the lower spacing member 29 is perpendicular to the vertical support members and is mounted by screws at each end to the horizontal bottom portions 21, 23. The spacing member is generally located approximately beneath the angled side portions 17, 19 so that a person can stand on the lower spacing member for stability when tension members 49, 51 are pulled upwardly from the side portions 17, 19. An upper spacing member is similarly anchored between the vertical support members proximate the top of the base portion to hold the support members apart in a rigid frame. The upper spacing member may comprise a seat 33, but preferably is an additional upper rigid bar or strap 31.

The stool-like base portion 11 of this device may include seat 33, which can be of any thickness or material, but is preferably rigid and has smooth surfaces. The seat is mounted to the upper portions of the angled side portions of the vertical support members by means of brackets 43 and fasteners 45, which may be removable hitch pins, disposed through the bracket and the tubing. The brackets may have slotted openings which allow the seat to be moved to a vertical position when the pins are removed. This position makes it possible for a person to stand and lean back against the seat to perform certain exercises made possible with the prior version of the exercising device and not described in detail herein.

Figure 2:
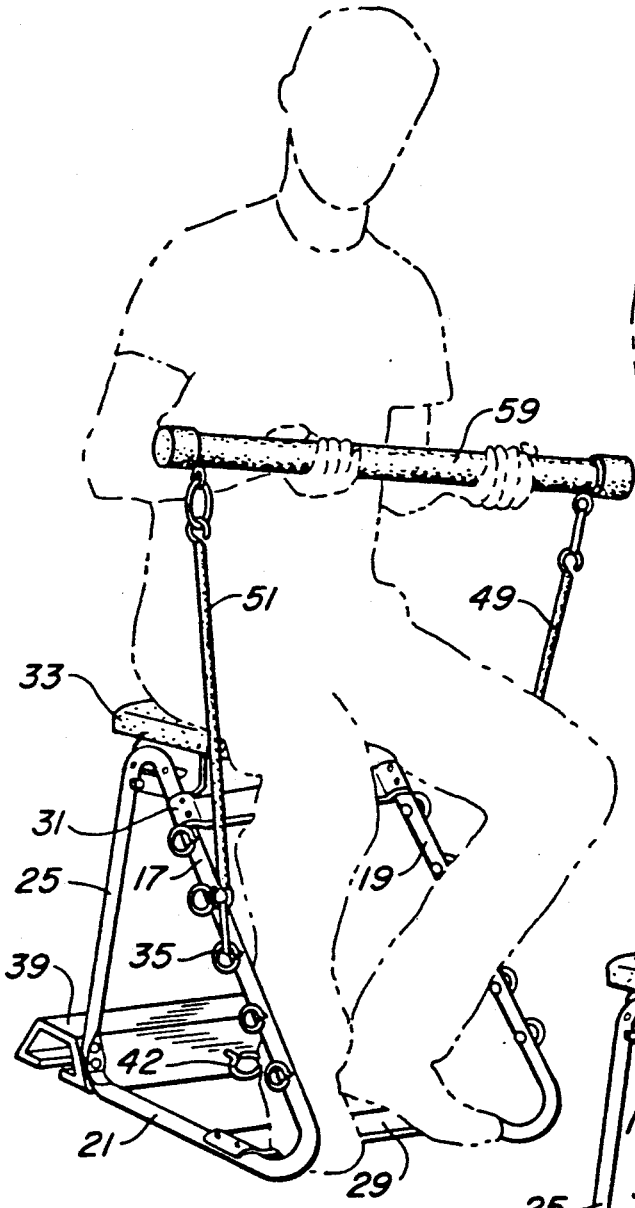
FIG. 2 is a front perspective view of the invention, 10 illustrating one embodiment of it in use.
Figure 2A:
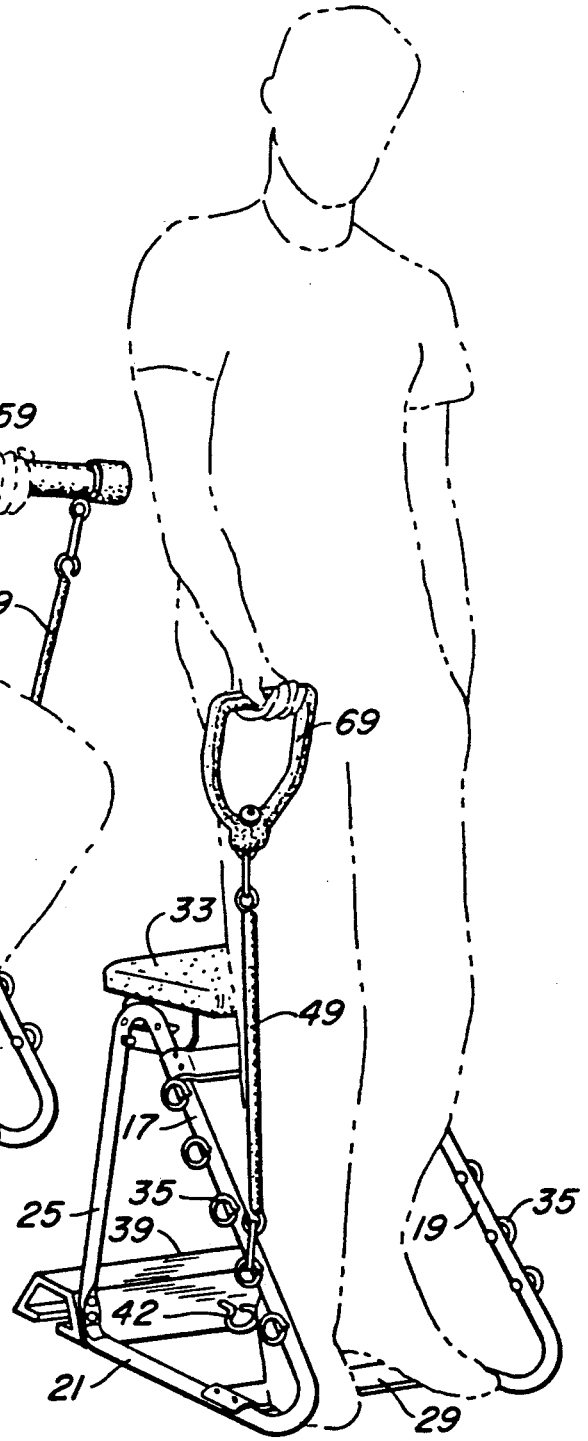
FIG. 2A is a front perspective view of the invention, illustrating the use of another embodiment of it.
Figure 3:
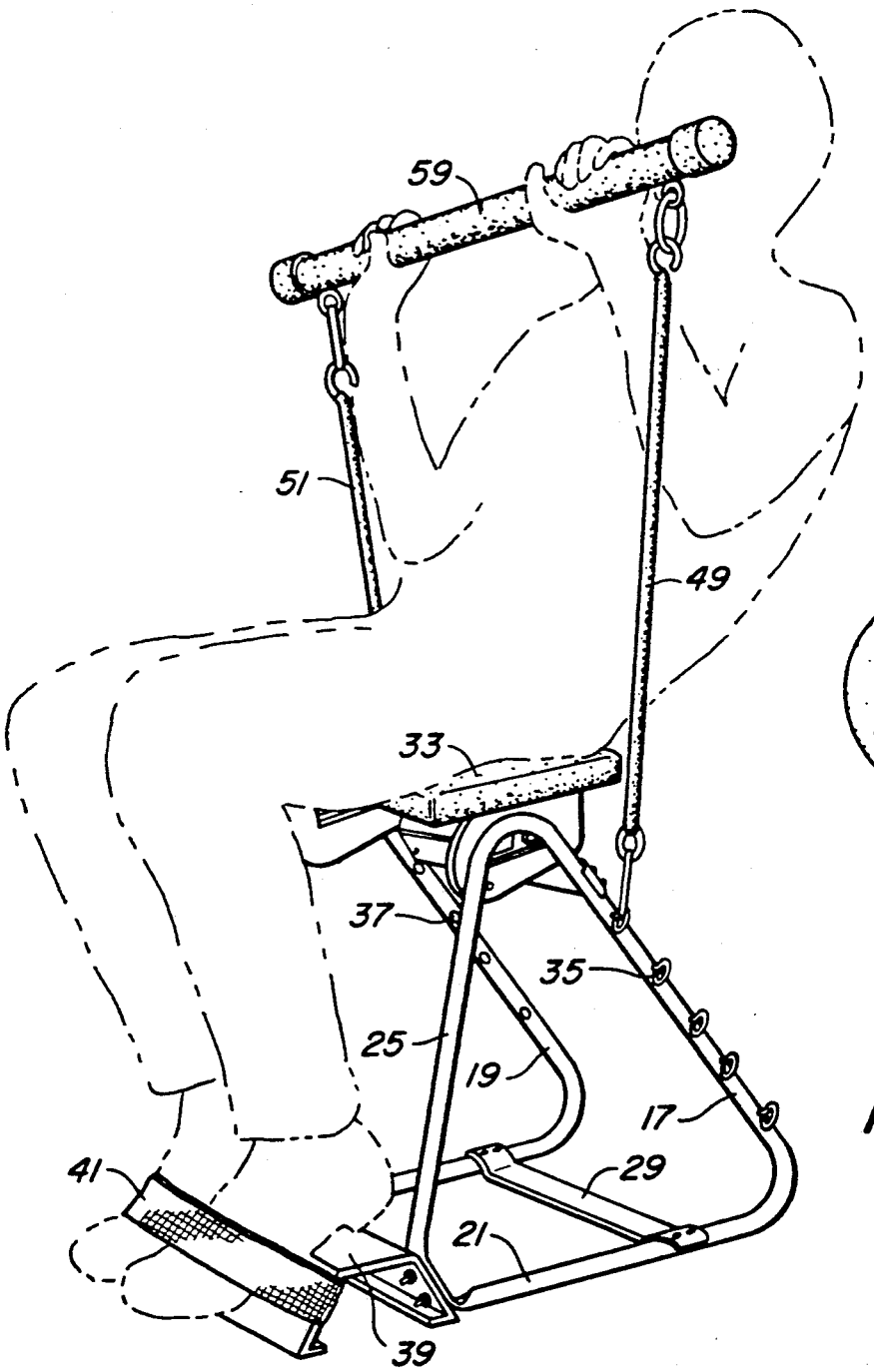
FIG. 3 is a rear perspective view of the invention, illustrating yet another use of it.

On at least one of the angled side portions 17 or 19 of the vertical support members 13, 15 securement means are disposed for securing the connecting means of tension members 49 or 51. The securement means includes a plurality of receiving members 35 disposed at spaced intervals along the angled side portion. These receiving members may be rigid loops or hooks, such as eye-bolts, which project from the vertical support member for easy access to the connecting means of the tension member. These receiving members are mounted securely to the support member. In the embodiment illustrated, a plurality of eye-bolts 35 are disposed through the tubular angled side portion of the support members and secured in position by locking means, such as nuts 37, disposed on the other side. Preferably, the receiving members are disposed on both vertical support members in corresponding increments equidistant from the ground along the angled side portions, providing securement means at varying distances from the ground for attaching a tension member. The variety of attachment positions, which provide different amounts of tension for different purposes, is illustrated in FIGS. 2, 2A and 3. The person exercising can adjust the position of attachment for his or her height and position and the degree of tension desired by moving the tension member to a lower or higher receiving member.

At least one tension member 49 or 51, having connecting means disposed at each end thereof, is attached to the stool-like base portion 11 of this invention. The tension member may be made from any elastic or resilient material or from coiled springs, etc. However, surgical tubing is a preferred material for the tension member since it provides the desired amount of tension, it is sturdy and retains its resiliency and it has a smooth surface which does not cause the potential injury of springs or coils. The length of the tension member is selected so that it will extend in an unstretched form to cover the distance from one of the mid-range receiving members 35 to the expected hand level of a typical user standing in a resting stage. In use, a tension member 49 is connected at its first end to the receiving member 35 of the angled side portion 17 or 19 of the vertical support member 13 or 15 and at its second end to a body engaging member 59, 69 or 85.

Figure 4:
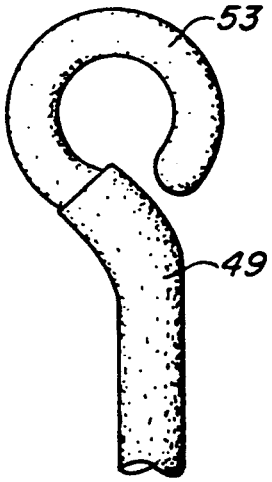
FIG. 4 is an enlarged front elevational view of the end of a tension member.

The connecting means disposed at each end of the tension member 49 includes a hook or loop 53 which can be anchored to the tubing and releasable clip portions 55 or 57 for detachably connecting one end of the tension member to a receiving member 35 disposed on the base portion 11 and the other end of the tension member to a receiving member 61, 77 or 91 on a body engaging member 59, 69 or 85, respectively. Preferably, a rigid, durable plastic hook 53 having a curved portion, is affixed to the surgical tubing 49, as seen in FIG. 4. The tubing is self-gripping when stretched over the curved portion of the hook but an adhesive is used as extra protection to ensure that the surgical tubing will be permanently affixed to the end of the hook, regardless of the force applied to the tension member. Releasable clips 55, 57 are secured to hooks 53, **53*a* at opposite ends of the tension member 49. Clip 55 will preferably be a latch-type or spring-snap clip; clip 57 may be a double end bolt snap which is detachable on both of its ends. Clips 55, 57 may be of the same type or they may be different, as illustrated herein, but each will generally be a fastener which can clip on and stay closed during use and not slip unexpectedly out of the hook 53 or 53*a*** or any of the various receiving members, but yet can be released easily by a person desirous of detaching the tension member from a particular receiving member.

At least one body engaging member 59, 69, or 85 attachable to the connecting means on one end of the tension member 49, is also part of this exercising device.

This invention allows the use of various body engaging members which can be attached to the tension member or members and which provide the exerciser with a means to pull the tension member away from the exercising device and create the resistance to work the muscle groups. One choice is a tubular bar 59 which has receiving means, such as receiving members 61, 63, proximate each end of the bar for securing tension member 49 and 51 to each end. The tubular bar is preferably made from a hollow, rigid plastic to which hooks or eye bolts 61, 63 are mounted and secured by nuts or other locking means mounted on the interior of the bar. End caps 65, 67 provide a smooth surface at each end. Connectors 55, 56 are attached to receiving members 61, 63 and tension members 49, 51 are attached to receiving members 35,35 on each vertical support member and the bar may then be gripped by the person exercising and pulled away from the base portion. The bar may be used to perform front curls from a standing or sitting position, as illustrated in FIG. 2, or military presses, as shown in FIG. 3, or various other routines in which a horizontal bar is raised away from the person or pulled toward him against tension on both ends. If the person is not sitting, it is desirable for him to stand on spacing member 29 to ensure the stability of the base portion.

Another form of body engaging member which may be employed with this invention is a rigid stirrup-like loop 69 or 71 which has a straight handle portion 73 or 75 and attachment means, such as a receiving member 77 or 79 anchored to a portion of the loop by locking member 81 or 83, which allows the stirrup-like loop to be attached to a tension member 49 or 51. The stirrup-like loop is preferably made from a rigid sturdy plastic. Connector 55 of the tension member 49 may be attached to receiving member 77 and the other end of the tension member is attached by connector 57 to receiving member 35. The stirrup may then be gripped by the hand as illustrated in FIG. 2A and pulled toward the body or away from the body forwardly or laterally in a variety of angles and directions to work different muscles in the upper body. Similarly, the stirrup-like loop 71 may be connected to tension member 51 and attached to the receiving members 35 disposed on the other angled side 19 of the base portion 11 and both stirrups may be pulled away from the body or towards each other.

Additional exercises are possible if a foot platform 39 is mounted to the rear portion of the vertical support members 13, 15, proximate their bottom horizontal portions 21, 23. The foot platform has a top portion 39*a*, an inside wall 39*b* and an outside wall 39*c*. It may have inwardly disposed bottom flanges 39*d* for extra stability. Strap 41, extending along outside wall 39*c* for its length, is attached in a known manner at each end to wall 39*c* of the foot platform. This strap is wide enough and resilient enough to allow the user, sitting on seat 33 and facing rearwardly of the base portion 11 to slip his or her feet between the strap 41 and the wall 39*c*, as shown in FIG. 3. As mentioned above, military presses can then be performed with the tubular bar 59.

In addition, the foot platform may be used conveniently for inner and outer leg exercises by mounting a receiving member, such as an eye bolt 42 onto the inner wall 39*b*, and suitably anchoring it by a nut similar to nuts 40 which anchor the foot platform to the base portion of the device, as shown in FIG. 1. A foot engaging stirrup comprises a wide strap 85 which is passed through an aligning loop 87 and may be adjusted to fit around the ankle of the exerciser. The strap is then secured by a locking means, such as Velcro 89. A receiving member 91, such as a spring snap, is connected to the loop 87. The tension member 49 may then be connected on one end by connector 57 to receiving member 42 and on the other end by connector 55 to receiving member 91 of the foot engaging strap 85 of the stirrup. An exerciser may then stand or squat and lean against the seat with the seat in a vertical position and exert pressure against strap 85 to pull the foot engaging stirrup away from base portion 11, creating resistance against muscle groups in the legs and adding another variation to the range of exercises made possible by this invention.

Thus, this invention provides a versatile exercising device which offers a range of customary movements against resistance, such as curls, flyes, presses, pullovers, crossovers, laterals, upright rows, triceps extensions, etc., particularly to muscle groups of the upper body, but also to abdominals and leg muscle groups, as well. This exercising device, which can be easily stored and moved for use, permits persons interested in such conditioning to perform customary workout routines in the privacy and convenience of their home, for instance while watching television, and without having to travel to another location. This invention is easily manufactured to be lightweight, yet sturdy and it provides a unique selection of features which the user can use for a comprehensive workout. The tension members can be used with the tubular bar, the stirrup-like loops or the ankle straps. The connecting means on the tension members allow the same tension members to be used with different body engaging members and temporarily anchored to different receiving members to increase or decrease the amount of resistance provided. Thus, this invention provides an exercising device which can easily be used in a private setting to perform very controlled anaerobic exercises and provides advantages over the other devices currently available for use in the home without the size and complexity of apparatus typically available in a gym.

It will be seen that the above-described exercising device will achieve a variety of objects and advantages attributed to it and, while it has been described in detail, it is not to be limited to such details except as may be necessitated by the appended claims.

I claim:

1. An exercising device comprising a rigid base portion having a pair of vertical support members, each of said vertical support members having a horizontal bottom portion, an angled side portion, said angled side portion forming an acute angle with said bottom portion, and a second side portion, and spacing means for securing the vertical support members in a spaced relation;

at least one tension member, said tension member having connecting means disposed on at least one end thereof;

at least one body engaging member disposed on one end of said tension member; and securement means disposed in a plurality of vertical positions on the angled side portion of at least one of the vertical support members for securing the connecting means of said tension member to a selected position on said angled side portion whereby the maximum tension on said body engaging member can be varied by securing said tension member to a different vertical position on the angled side portion.

2. The exercising device of claim 1 wherein the securement means comprises receiving members having apertures, each aperture adapted to receive a releasable fastener disposed at one end of the tension member.

3. The exercising device of claim 1 wherein each of the angled side portions of the vertical support members comprises securement means and the body engaging member comprises a tubular bar having receiving means proximate each end for securing a tension member, said tension member being secured at one of its ends to said receiving means and at its other end to the securement means of one of the angled side portions.

4. The exercising device of claim 1 wherein the body engaging member is a stirrup having a straight handle portion and attachment means for attaching the stirrup to a tension member.

5. The exercising device of claim 1 wherein the spacing means comprises a lower spacing member and an upper spacing member, said spacing members securing the vertical support members in a spaced relation to each other.

6. The exercising device of claim 1 further comprising a seat disposed proximate the top of said vertical support members.

7. The exercising device of claim 1 wherein each vertical support member comprises a continuous lightweight tubular material formed into a generally triangular shape.

8. An exercising device comprising a rigid base portion having a pair of vertical support member, each of said vertical support members having a horizontal bottom portion, an angled side portion which forms an acute angle in a vertical plane with said bottom portion, and a second side portion; said base portion also having at least one lower spacing member for securing the bottom portions of said vertical support members in a spaced relation and an upper spacing member for securing the upper portions of the vertical support members in a spaced elation;

securement means comprising rigid receiving members having apertures disposed in spaced relation in a plurality of positions along each of the angled side portions of the vertical support members whereby the apertures on each angled side portion are disposed at different vertical distances from said horizontal bottom portion;

at least one tension member having connecting means disposed on at least one end thereof, the connecting means of said tension member comprising a snap-on fastener having a portion removably insertable into one of said apertures of said rigid receiving members, and at least one body engaging member removably attachable to the other end of said tension member.

9. The exercising device of claim 8, further comprising a seat disposed proximate the top of said vertical support members.

10. The exercising device of claim 8 wherein each of said vertical support members is formed with an open construction and said horizontal bottom portions, said side portions and said angled side portions are formed from continuous lightweight tubular material.

11. The exercising device of claim 8 wherein a feet engaging platform is mounted to the vertical support members proximate said second side portions thereof.

12. The exercising device of claim 11 wherein the feet engaging platform comprises at least one rigid receiving member for detachably securing the connecting means disposed on one end of said tension member.

13. The exercising device of claim 8 wherein said tension member has connecting means disposed at each end thereof, the connecting means of one end comprising releasable clip means for attachment to a receiving member of the angled side portion of the vertical support member and the connecting means on the other end comprising releasable clip means for attachment to a body engaging member.

14. The exercising device of claim 13 wherein the body engaging member comprises a tubular bar having receiving means for securing a tension member proximate each end, said tension member being secured at one of its ends to said receiving means and at its other end to an aperture of a receiving member disposed on one of the angled side portions.

15. The exercising device of claim 14 wherein the box engaging member is a stirrup having a straight handle portion a attachment means for attaching the stirrup to a tension member.

16. An exercising device comprising a rigid base portion having a pair of vertical support member for placement on a generally horizontal surface, each of same vertical support members having an angled side portion and a second side portion, said angled side portion forming an acute angle with the horizontal surface, and spacing means for securing the vertical support members in a spaced relation;

at least one tension member, said tension member having connecting means disposed on at least one end thereof;

at least one body engaging member disposed on one end of same tension member; and securement means disposed in a plurality of vertical position on the angled side portion of at least one of the vertical support members for securing the connecting means of said tension member a selected position on said angled side portion whereby the maximum tension on said body engaging member can be varied by securing same tension member to a different vertical position on the angled side portion.

* * * * *

UNITED STATES PATENT AND TRADEMARK OFFICE

CERTIFICATE OF CORRECTION

PATENT NO. :5,112,287

DATED :May 12, 1992

INVENTOR(S) :Aaron Brewer

It is certified that error appears in the above—identified patent and that said Letters Patent is hereby corrected as shown below:

Col. 2, line 61, delete the numeral "10" at the end of the line.

In the Claims:

Claim 8, Col. 7, line 33, at beginning of line, "member" should read --members--; in line 42, "elation" should read --relation--.

Claim 15, Col. 8, line 31, "box" should read --body--; in line 33, "a" should read --and--; in line 37, "member" should read --members--; in line 38, "same" should read --said--; in line 48, "same" should read --said--; in line 50, "position" should read ---positions--; in line 52, insert between the words "member" and "a" the word --to--; and in line 55, "same" should be --said--.

Signed and Sealed this

Thirteenth Day of July, 1993

*Attest:*

Michael K. Kirk

MICHAEL K. KIRK

*Attesting Officer*

*Acting Commissioner of Patents and Trademarks*